United States Patent [19]

Powell et al.

[11] 4,318,774

[45] Mar. 9, 1982

[54] COMPOSITE NONWOVEN WEB

[75] Inventors: Henry J. Powell, Andover; Albert G. Hoyle, Lowell, both of Mass.

[73] Assignee: Powell Corporation, Andover, Mass.

[21] Appl. No.: 145,463

[22] Filed: May 1, 1980

[51] Int. Cl.[3] ..... D21H 1/02

[52] U.S. Cl. ..... 162/129; 162/132; 162/145; 162/146; 162/188; 162/206; 210/507; 210/508; 210/509; 55/487; 55/527

[58] Field of Search ..... 162/129, 132, 133, 145, 162/146, 188, 206; 210/507, 508, 509, 505, 491; 55/527, 528, 487

[56] References Cited

U.S. PATENT DOCUMENTS

| | | | |
|---|---|---|---|
| 3,674,621 | 7/1972 | Miyamoto et al. | 162/146 |
| 3,779,244 | 12/1973 | Weeks et al. | 55/527 |
| 4,046,622 | 9/1977 | Attwood et al. | 162/132 |
| 4,084,949 | 4/1978 | Biggins | 55/527 |

*Primary Examiner*—William F. Smith
*Attorney, Agent, or Firm*—Morse, Altman, Oates & Dacey

[57] ABSTRACT

The properties of nonwoven glass fiber and nonwoven polymer fiber are combined efficaciously in a composite web that comprises two component webs of particular composition. One of the component webs is formed by screen casting, squeezing, and drying an aqueous dispersion of glass fiber, thermoplastic fiber, and a hydrophilic polymer so that temporary adhesion bonding occurs. The other of the component webs is formed by orienting textile polymer fiber and thermoplastic fiber so that temporary matting occurs. The composite web is formed by superposing and calendering the component webs under heat and pressure so that fusion bonding of the thermoplastic fiber occurs within each and between both of the component webs. As a result, the glass fiber and textile fiber are predeterminedly locked and the properties of both are predeterminedly available.

3 Claims, 1 Drawing Figure

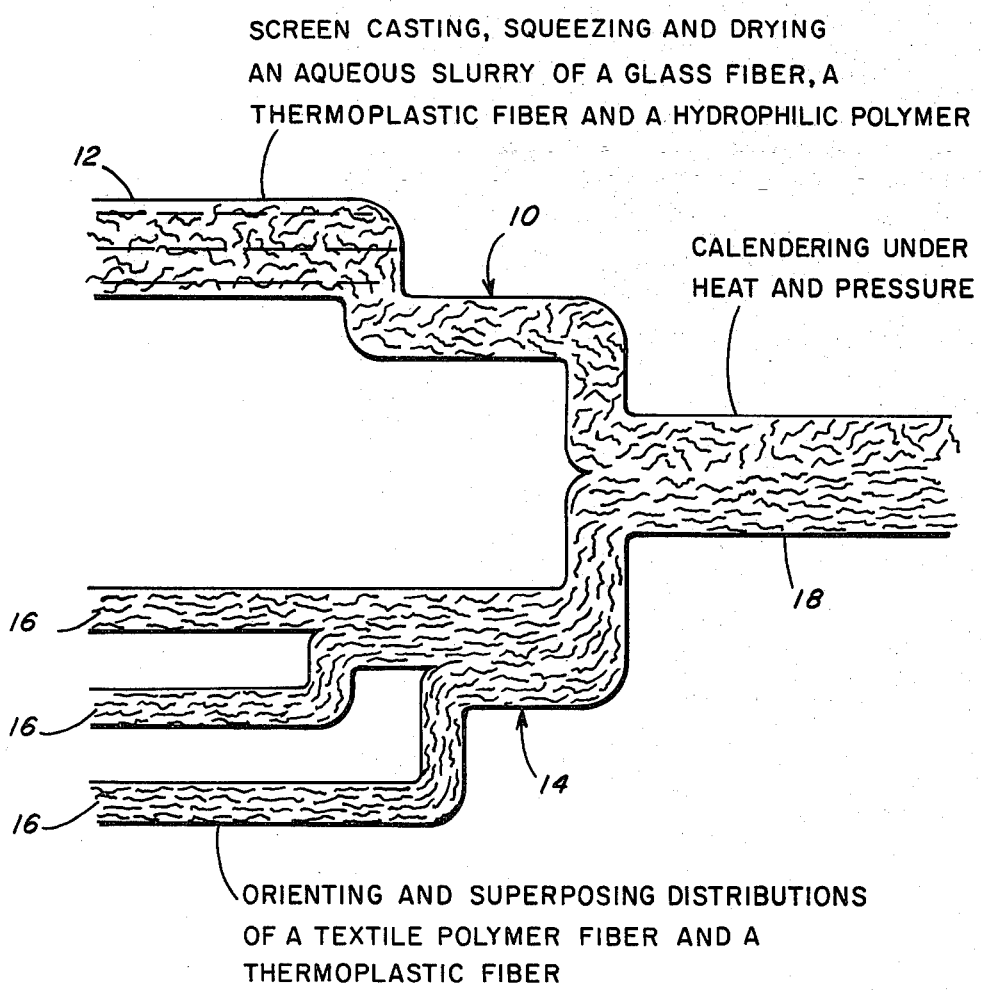
SCREEN CASTING, SQUEEZING AND DRYING
AN AQUEOUS SLURRY OF A GLASS FIBER, A
THERMOPLASTIC FIBER AND A HYDROPHILIC POLYMER
12
10
CALENDERING UNDER
HEAT AND PRESSURE
18
16
16
16
14
ORIENTING AND SUPERPOSING DISTRIBUTIONS
OF A TEXTILE POLYMER FIBER AND A
THERMOPLASTIC FIBER

COMPOSITE NONWOVEN WEB

BACKGROUND OF THE INVENTION

1. Field of the Invention

The present invention relates to the production and structure of nonwoven webs and, more particularly, to nonwoven webs, in which glass fibers and synthetic polymeric fibers are combined.

2. The Prior Art

Various combinations of glass fiber and synthetic polymeric fiber have been proposed in prior efforts to achieve nonwoven webs having the tensile, electrical, thermal, and chemical properties of the former and the textile properties of the latter. These prior efforts typically have involved undesired bonding materials and/or undesired structural fiber distributions, which have tended to mask or mute the desired properties of both the glass fiber and the synthetic polymer fiber.

SUMMARY OF THE INVENTION

The primary object of the present invention is to combine the properties of nonwoven glass fiber and nonwoven polymer fiber efficaciously in a composite web that comprises two component webs of particular composition. One of the component webs is formed by screen casting, squeezing, and drying an aqueous dispersion of glass fiber, thermoplastic fiber, and a hydrophilic polymer so that temporary adhesion bonding occurs. The other of the component webs is formed by orienting textile polymer fiber and thermoplastic fiber so that temporary matting occurs. The composite web is formed by superposing and calendering the component webs under heat and pressure so that permanent fusion bonding of the thermoplastic fiber occurs within each and between both of the component webs. As a result, the glass fiber and textile fiber are predeterminedly locked and the properties of both are predeterminedly available.

Other objects of the present invention will in part be obvious and will in part appear hereinafter.

The invention accordingly comprises the processes, products, steps, components, and interrelationships, which are exemplified in the present disclosure, the scope of which will be indicated in the appended claims.

BRIEF DESCRIPTION OF THE DRAWING

For a fuller understanding of the nature and objects of the present invention, reference is made to the accompanying drawing wherein the single FIGURE depicts the process steps and final product of the present invention.

DETAILED DESCRIPTION OF THE PREFERRED EMBODIMENT

Generally, as shown in the drawing, the process of the present invention comprises the steps of: (1) forming at least a first component web 10 by fourdrinier casting, squeezing, and drying an aqueous dispersion 12 of a glass fiber, a thermoplastic fiber, and a hydrophilic bonding agent; (2) forming at least a second component web 14, and preferably a plurality of webs 14, by carding a substantially dry distribution 16 of a synthetic textile fiber and a thermoplastic fiber; and (3) calendering the component webs under sufficient heat and pressure so that fusion bonding of the thermoplastic fiber occurs within each and at the interfaces between the component webs. It will be understood that the textile fiber, as referred to herein, is a relatively high fusion point thermoplastic in contrast to the thermoplastic fiber, as referred to herein, which is a relatively low fusion point thermoplastic. It is critical that the thermoplastic fiber of the first component web and the thermoplastic fiber of the second component web be fusibly compatible. It is preferred that the thermoplastic fiber be fusibly compatible with the textile fiber. In the resulting web 18, the glass fiber and the textile fiber are locked in position by the thermoplastic fiber and typical properties of a glass fiber web and a textile fiber web are preserved. Such a composite web is applicable for electrical insulation, fluid filtration, and structural configuration.

The structure of component web 10 is as follows. Preferably, the bulk of the glass fiber, say in excess of 70% of the glass fiber, is characterized by a diameter in the range of from 0.63 to 15.2 microns and a length of from $\frac{1}{8}$ inch to $\frac{3}{4}$ inch. Best results are achieved when the glass fiber is characterized by a diameter in the range of from 3.2 to 6.35 microns and a length in the range of from $\frac{1}{8}$ to $\frac{1}{4}$ inch. The thermoplastic fiber in component web 10 preferably has a fusion point in the range of from 200° to 450° F. and is selected from the class consisting of polyesters such as polyethylene terephthalate, polyolefins such as polyethylene and polypropylene, polyvinyls such as polyvinyl chloride and polyvinylidene chloride, polyamides such as polyhexamethylene adipamide, and polyacrylics such as polyacrylonitrile. The hydrophilic polymer in component web 10 preferably is a water soluble synthetic polymer, initially in the particulate form of either powder or fiber, selected from the class consisting of polyvinyl alcohol, carboxymethyl cellulose, methocel-ether mixture, or polyvinyl pyrollidone. It is required that the dissolved synthetic polymer be compatible, from a physicochemical standpoint, in an aqueous slurry with the suspended glass fiber and thermoplastic fiber. This initial slurry, by total weight, preferably contains from 40 to 94% glass fiber, from 5 to 50% thermoplastic fiber, from 1 to 10% dissolved synthetic polymer, and a remainder of water.

The structure of component web 14 is as follows. The textile fiber is of the type that possesses sufficient tensile strength for textile spinning and weaving, i.e. at least 1 gram per denier. Preferably this textile fiber is composed of a synthetic polymer selected from the class consisting of polyesters such as polyethylene terephthalate, polyamides such as polyhexamethylene adipamide and aramid, polyvinyls such as polyvinyl chloride, polyolefins such as polyethylene and polypropylene, polyacrylics such as polyacrylonitrile, and cellulosics such as rayon. Preferably the textile fiber is characterized by a denier per filament in the range of from 1.0 to 10 and a length in the range of from $\frac{1}{4}$ to 3 inches. The thermoplastic fiber of component web 14 preferably has a fusion point in the range of from 200° to 450° F. and is selected from the class consisting of homopolymers, copolymer, interpolymers, and cross-polymers of polyesters such as polyethylene terephthalate, polyolefins such as polyethylene and polypropylene, polyvinyls such as polyvinyl chloride, polyamides such as polyhexamethylene adipamide, and polyacrylics such as polyacrylonitrile. Preferably the thermoplastic fiber is characterized by a denier per filament in the range of from 1.0 to 10 and a length in the range of from $\frac{1}{4}$ to 4 inches. This fiber mixture, by total weight, preferably includes from 10 to 90% textile fiber and from 10 to 90% thermoplastic fiber.

As indicated above, component web 10 is formed on a fourdrinier machine. The process involves casting the slurry of fiber on an advancing screen to remove water and advancing the resulting wet sheet through suction, squeeze, and drying stations to form a self-supporting sheet. Component web 14 is formed by advancing masses of the dry filter through separate carding sequences to produce a plurality of thin carded strata and advancing the carded strata into intimate superposition. The two component webs are combined by superposition, under a pressure in the range of from 100 to 1000 pounds per lineal inch at a temperature in the range of from 200° to 450° F. This temperature, of course, is distinctly lower, i.e. at least 5° C. lower, than the fusion or melting points of the glass fiber and the textile fiber. In the illustrated process, the pressure is applied by heated calendering rolls, between which the component webs are advanced at a speed in the range of from 5 to 100 yards per minute. After formation of the composite sheet, in one form of the present invention, the soluble synthetic polymer is washed out of the composite sheet. In an alternative embodiment, the carded strata of the textile fiber web are bonded between calendering rolls under heat and pressure as above before being bonded to the glass fiber web.

The following non-limiting example further illustrates the present invention.

EXAMPLE

A composite web embodying the present invention was fabricated from the following materials in the following steps.

Glass Fiber of Web 10

Composition—calcium alumina borosilicate
Fiber diameter—4.6 microns
Denier per filament—0.45
Tenacity—7.0 grams per denier
Density—2.54 grams per cubic centimeter
Average fiber length—$\frac{1}{8}$"

Thermoplastic Fiber of Web 10

Composition—polyester
Staple length—$\frac{1}{4}$"
Denier per filament—5
Temperature of fusion—280° F.
Readily dispersible in water

Hydrophilic Polymer of Web 10

Composition—polyvinyl alcohol fiber
Denier per filament—1.1
Length—0.2 inch
Grams per denier—3.4
Completely soluble in water at 60°-70° C.
When dry, binds glass fiber and thermoplastic fiber into cohesive stratum.

Web 10-Formation

Total Weight—70 grams per square yard
Thickness—0.015 inch
Proportion of glass by total weight—80%
Proportion of polyester fiber by total weight—14%
Proportion of polyvinyl alcohol by total weight—6%

Textile Fiber of Web 14

Composition—polyethylene terephthalate homopolymer
Tenacity—4.5-5.5 grams per denier
Crimp—10 per inch
Staple length—$1\frac{1}{2}$ inches
Hot air shrinkage (350° F.)—5.0 to 7.0%
Fusion point—480° F.
Melting point—490° to 500° F.
Density—1.38 grams per cubic centimeter
Elongation at break—10 to 40%
Attenuation state—fully drawn

Thermoplastic Fiber of Web 14

Composition—polyethylene terephthalate homopolymer
Tenacity—1.5 grams per denier
Crimp—11 per inch
Staple length—$1\frac{1}{2}$ inch
Hot air shrinkage (350° F.)—55 to 75%
Fusion point—200° F.
Melting point—490° to 500° F.
Density—1.38 grams per cubic centimeter
Elongation at break—325 to 450%
Attenuation state—partially drawn

Web 14-Formation

Textile and thermoplastic fibers mixed and carded into three sub-component strata, each weighing—6.66 grams per square yard
Total weight—20 grams per square yard
Proportion of textile fiber by total weight—approximately 75%
Proportion of thermoplastic fiber by total weight—approximately 25%
Proportion of organic finish on textile fibers—0.1%

Calender Processing

Calender includes pair of rolls.
Rigid metal roll with surface temperature 415° F.
Compliant felt roll with surface of Shore durometer 83D
Roll pressure—480 pounds per lineal inch
Advancing speed—10 yards per minute
Thermoplastic fibers are caused to flow under heat and pressure
Final composite sheet thickness—0.005 inch
Final composite sheet weight—90 grams per square yard

OPERATION AND CONCLUSION

The structure of the composite sheet of the present invention is such that a discrete glass fiber distribution and a discrete textile fiber distribution are locked together so that the bonding integrity is uniform throughout the entire cross section of the two combined strata. As a result, the glass fiber distribution and the textile fiber distribution retain their individual characteristics. In electrical insulation applications, this composite sheet possesses the inherent electrical properties of glass, in addition to absorptivity, conformability, and moldability. In filtration applications, this composite sheet possesses smooth surfaces, biological inertness, durability, variable porosity index, variable loading capacity, toughness, and resistance to glass "dusting". In reinforced plastic applications, this composite sheet provides a readily saturable and conformable web capable of reproducibly assuming predetermined finished shapes.

Since certain changes may be made in the present invention without departing from the scope of the present invention, it is intended that all matter described in the foregoing specification and shown in the accompanying drawing be interpreted in an illustrative and not in a limiting sense.

What is claimed is:

1. A process for producing a composite sheet, said process comprising the steps of:

(a) forming a first stratum by screen casting and drying an aqueous slurry containing a distribution of glass fiber, thermoplastic fiber and hydrophilic polymer, said glass fiber and said thermoplastic fiber in said first stratum being bonded by said hydrophilic polymer;

(b) forming a second stratum by orienting a distribution of a textile polymer fiber and a thermoplastic fiber, said polymer fiber and said thermoplastic fiber in said second stratum being bonded by matting;

(c) said thermoplastic fiber of said first stratum and said thermoplastic fiber of said second stratum being compatible;

(d) calendering said first stratum and said second stratum in superposition under heat and pressure to fuse said thermoplastic fiber of said first stratum and said thermoplastic fiber of said second stratum;

(e) said first stratum, by total weight, containing a glass fiber to textile polymer fiber ratio of (from 40 to 94%) divided by (from 5 to 50%);

(f) said second stratum, by total weight, containing from 10 to 90% textile polymer fiber and from 10 to 90% thermoplastic fiber;

(g) said textile polymer fiber being composed of a material selected from the class consisting of polyesters, polyamides, polyvinyls, polyolefins, polyacrylics, and cellulosics;

(h) said thermoplastic fiber having a fusion point within the range of 200° to 450° F.;

(i) said textile polymer fiber and said glass fibers having fusion points above said thermoplastic fibers.

2. A process for producing a composite sheet, said process comprising the steps of:

(a) forming a first stratum by fourdrinier casting and drying an aqueous slurry containing a distribution of glass fiber, thermoplastic fibrous materials and hydrophilic polymer, said glass fiber and said thermoplastic fibrous material in said first stratum being bonded by said hydrophilic polymer;

(b) forming a second stratum by carding a distribution of a textile polymer fiber and a thermoplastic fibrous material, said polymer fiber and said thermoplastic fiber in said second stratum being bonded by matting;

(c) said thermoplastic fibrous material of said first startum and thermoplastic fibrous material of said second stratum being compatible;

(d) calendering said first stratum and said second stratum in superposition under heat and pressure to fuse said thermoplastic fibrous materialer of said first stratum and said thermoplastic fibrous material of said second stratum;

(e) said first stratum, by total weight, containing a glass fiber to textile polymer fiber ratio of (from 40 to 94%) divided by (from 5 to 50%);

(f) said second stratum, by total weight, containing from 10 to 90% textile polymer fiber and from 10 to 90% thermoplastic fibrous material;

(g) said textile polymer fiber being composed of a material selected from the class consisting of polyesters, polyamides, polyvinyls, polyolefins, polyacrylics, and cellulosics;

(h) said thermoplastic fibrous material having a fusion point within the range of 200° to 450° F.;

(i) said textile polymer fiber and said glass fibers having fusion points distinctly above the fusion point of said thermoplastic fibrous material.

3. A composite sheet structure comprising:

(a) a first cohesive stratum and a second cohesive stratum;

(b) said first cohesive stratum containing a discrete distribution of nonwoven glass fiber and a discrete distribution of a hydrophilic polymer;

(c) said second cohesive stratum being composed of a plurality of layers, each containing a discrete distribution of nonwoven textile polymer fiber and being cohesive by the temporary matting of said fibers;

(d) said first cohesive stratum and said second cohesive stratum containing a distribution of nonwoven thermoplastic fibrous material, of which part is interspersed with said glass fiber and part is interspersed with said textile polymer fiber;

(e) said discrete distribution of said hydrophilic polymer binding said nonwoven glass fiber and said nonwoven thermoplastic fibrous material into said first cohesive stratum;

(f) said glass fiber, said textile polymer fiber, and said thermoplastic fibrous material being locked in position within said composite sheet structure between said first and second cohesive stratums and also within each of said first and second cohesive stratums primarily by fusion of said thermoplastic fibrous material to said glass fiber and to said textile polymer of said first and second cohesive stratums;

(g) said first stratum, by total weight, containing a glass fiber to textile polymer fiber ratio of (from 40 to 94%) divided by (from 5 to 50%);

(h) said second stratum, by total weight, containing from 10 to 90% textile polymer fiber and from 10 to 90% thermoplastic fibrous material;

(i) said textile polymer fiber being composed of a material selected from the class consisting of polyesters, polyamides, polyvinyls, polyolefins, polyacrylics, and cellulosics;

(j) said thermoplastic fibrous materials having fusion points within the range of 200° to 450° F.;

(k) said textile polymer fiber and said glass fibers having fusion points distinctly higher than said thermoplastic fibrous material.

* * * * *